US010142732B2

(12) United States Patent
Oswell

(10) Patent No.: US 10,142,732 B2
(45) **Date of Patent: *Nov. 27, 2018**

(54) MODULAR AUDIO SYSTEM AND METHOD

(71) Applicant: ROSWELL CANADA, INC., Acheson (CA)

(72) Inventor: Robert Oswell, Acheson (CA)

(73) Assignee: ROSWELL CANADA, INC., Acheson (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/673,847

(22) Filed: Aug. 10, 2017

(65) Prior Publication Data

US 2017/0339490 A1 Nov. 23, 2017

Related U.S. Application Data

(63) Continuation of application No. 14/508,300, filed on Oct. 7, 2014, now Pat. No. 9,743,180.

(60) Provisional application No. 61/887,557, filed on Oct. 7, 2013.

(51) Int. Cl.
*H04R 3/04* (2006.01)
*H04R 27/00* (2006.01)

(52) U.S. Cl.
CPC ..... *H04R 3/04* (2013.01); *H04R 27/00* (2013.01); *H04R 2227/003* (2013.01); *H04R 2227/005* (2013.01)

(58) Field of Classification Search
CPC ... H04R 3/02; H04R 3/04; H04R 3/12; H04R 27/00; H04R 2227/003; H04R 2227/005
See application file for complete search history.

(56) References Cited

U.S. PATENT DOCUMENTS

2009/0214051 A1* 8/2009 Lockett ..... H04N 7/163 381/77
2011/0268286 A1* 11/2011 Sanchez ..... H04R 27/00 381/59
2013/0064389 A1* 3/2013 Jacobs ..... H04R 27/00 381/87
2013/0178963 A1* 7/2013 Bergmann ..... G11B 20/10 700/94

* cited by examiner

*Primary Examiner* — Brenda C Bernardi
(74) *Attorney, Agent, or Firm* — Tai W. Nahm; Miller Thomson LLP

(57) ABSTRACT

A method, computer program product, and computer system for receiving an indication that a first module is operatively connected to a main module, wherein the first module and the main module include hardware modules. A type of speaker operatively connected to the first module is identified. The type of speaker is matched to a speaker profile, wherein the speaker profile includes a predefined sound curve setting. The first module is tuned to the predefined sound curve setting based upon, at least in part, matching the type of speaker to the speaker profile.

20 Claims, 6 Drawing Sheets

10

MODULAR AUDIO SYSTEM AND METHOD

RELATED CASES

This application is a continuation of U.S. application Ser. No. 14/508,300, filed on 7 Oct. 2014, which claims the benefit of U.S. Provisional Application No. 61/887,557, filed on 7 Oct. 2013. The contents of these applications are all incorporated by reference.

BACKGROUND

On a basic level, audio systems may generally include, e.g., a receiver and/or one or more speakers. For example, the receiver may include an amplifier to amplify (and change) the sound signal from any number of audio sources (e.g., radio, computing devices, etc.), which may then be heard via the speakers.

Generally, each speaker may be unique in that the sound signal received by the amplifier may be improved if the amplifier settings specific to the speaker are tuned as closely as possible to a "perfect sound curve". Typically, if a user desires to tune the amplifier to achieve this perfect sound curve, the user may be required to manually adjust the components of the amplifier (e.g., from within). Additionally, if the user desires to add more speakers, the user may be required to manually add more amplifiers, which may result in additional wiring and/or rewiring of the current audio system configuration.

BRIEF SUMMARY OF THE DISCLOSURE

In one example implementation, a method, performed by one or more computing devices, may include but is not limited to receiving an indication that a first module is operatively connected to a main module, wherein the first module and the main module may include hardware modules. A type of speaker operatively connected to the first module may be identified. The type of speaker may be matched to a speaker profile, wherein the speaker profile may include a predefined sound curve setting. The first module may be tuned to the predefined sound curve setting based upon, at least in part, matching the type of speaker to the speaker profile.

One or more of the following example features may be included. A selection of the first module for inclusion in at least one zone of a plurality of zones may be received, wherein each module included in the at least one zone may operate in sync. Each module included in the at least one zone may be individually controllable while operating in sync. At least one module may be identified by external display. The type of speaker operatively connected to the first module may be automatically identified when the first module is operatively connected to the main module. The main module may include a multipin connector that operatively connects the main module to the first module. Receiving the indication that the first module is operatively connected to the main module may include receiving the indication wirelessly from a remote computing device. The speaker profile may be stored within the main module. The first module may be automatically tuned by the main module to the predefined sound curve setting based upon, at least in part, matching the type of speaker to the speaker profile.

In another example implementation, a computing system includes a processor and a memory configured to perform operations that may include but are not limited to receiving an indication that a first module is operatively connected to a main module, wherein the first module and the main module may include hardware modules. A type of speaker operatively connected to the first module may be identified. The type of speaker may be matched to a speaker profile, wherein the speaker profile may include a predefined sound curve setting. The first module may be tuned to the predefined sound curve setting based upon, at least in part, matching the type of speaker to the speaker profile.

One or more of the following example features may be included. A selection of the first module for inclusion in at least one zone of a plurality of zones may be received, wherein each module included in the at least one zone may operate in sync. Each module included in the at least one zone may be individually controllable while operating in sync. At least one module may be identified by external display. The type of speaker operatively connected to the first module may be automatically identified when the first module is operatively connected to the main module. The main module may include a multipin connector that operatively connects the main module to the first module. Receiving the indication that the first module is operatively connected to the main module may include receiving the indication wirelessly from a remote computing device. The speaker profile may be stored within the main module. The first module may be automatically tuned by the main module to the predefined sound curve setting based upon, at least in part, matching the type of speaker to the speaker profile.

In another example implementation, a computer program product resides on a computer readable storage medium that has a plurality of instructions stored on it. When executed by a processor, the instructions cause the processor to perform operations that may include but are not limited to receiving an indication that a first module is operatively connected to a main module, wherein the first module and the main module may include hardware modules. A type of speaker operatively connected to the first module may be identified. The type of speaker may be matched to a speaker profile, wherein the speaker profile may include a predefined sound curve setting. The first module may be tuned to the predefined sound curve setting based upon, at least in part, matching the type of speaker to the speaker profile.

One or more of the following example features may be included. A selection of the first module for inclusion in at least one zone of a plurality of zones may be received, wherein each module included in the at least one zone may operate in sync. Each module included in the at least one zone may be individually controllable while operating in sync. At least one module may be identified by external display. The type of speaker operatively connected to the first module may be automatically identified when the first module is operatively connected to the main module. The main module may include a multipin connector that operatively connects the main module to the first module. Receiving the indication that the first module is operatively connected to the main module may include receiving the indication wirelessly from a remote computing device. The speaker profile may be stored within the main module. The first module may be automatically tuned by the main module to the predefined sound curve setting based upon, at least in part, matching the type of speaker to the speaker profile.

The details of one or more example implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
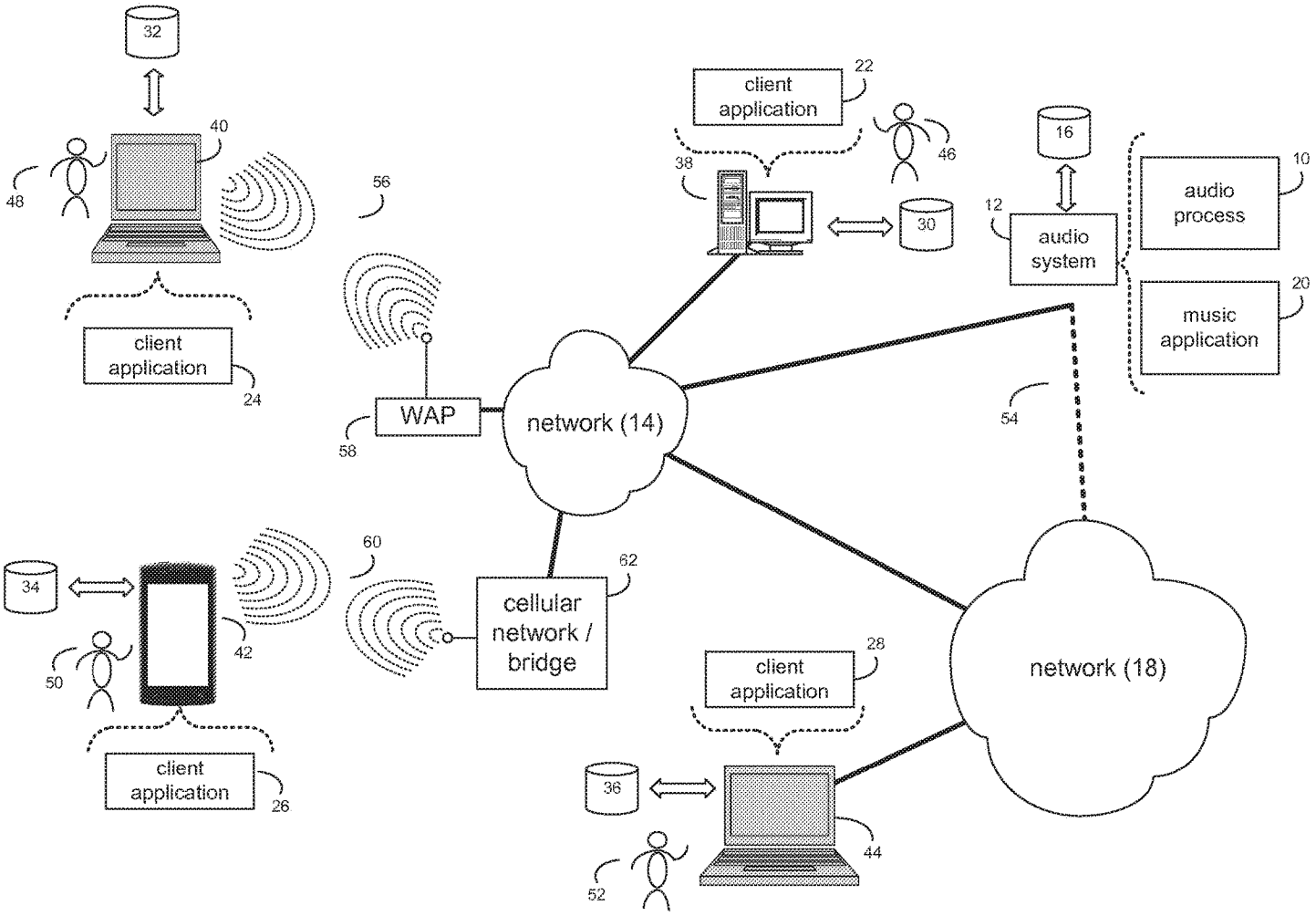
FIG. 1 is an example diagrammatic view of an audio process coupled to a distributed computing network according to one or more example implementations of the disclosure.

System Overview:

As will be appreciated by one skilled in the art, the present disclosure may be embodied as a method, system, or computer program product. Accordingly, the present disclosure may take the form of an entirely hardware implementation, an entirely software implementation (including firmware, resident software, micro-code, etc.) or an implementation combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium (or media) may be utilized. The computer readable medium may be a computer readable signal medium or a computer readable storage medium. The computer-usable, or computer-readable, storage medium (including a storage device associated with a computing device or client electronic device) may be, for example, but is not limited to, an electronic, magnetic, optical, electromagnetic, infrared, or semiconductor system, apparatus, device, or any suitable combination of the foregoing. More specific examples (a non-exhaustive list) of the computer-readable medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a digital versatile disk (DVD), a static random access memory (SRAM), a memory stick, a floppy disk, a mechanically encoded device such as punch-cards or raised structures in a groove having instructions recorded thereon, a media such as those supporting the internet or an intranet, or a magnetic storage device. Note that the computer-usable or computer-readable medium could even be a suitable medium upon which the program is stored, scanned, compiled, interpreted, or otherwise processed in a suitable manner, if necessary, and then stored in a computer memory. In the context of the present disclosure, a computer-usable or computer-readable, storage medium may be any tangible medium that can contain or store a program for use by or in connection with the instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. The computer readable program code may be transmitted using any appropriate medium, including but not limited to the internet, wireline, optical fiber cable, RF, etc. A computer readable signal medium may be any computer readable medium that is not a computer readable storage medium and that can communicate, propagate, or transport a program for use by or in connection with an instruction execution system, apparatus, or device.

Computer program code for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java®, Smalltalk, C++ or the like. Java and all Java-based trademarks and logos are trademarks or registered trademarks of Oracle and/or its affiliates. However, the computer program code for carrying out operations of the present disclosure may also be written in conventional procedural programming languages, such as the "C" programming language, PASCAL, or similar programming languages, as well as in scripting languages such as Javascript or PERL. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the internet using an Internet Service Provider). In some implementations, electronic circuitry including, for example, programmable logic circuitry, field-programmable gate arrays (FPGA), micro-controller units (MCUs), or programmable logic arrays (PLA) may execute the computer readable program instructions/code by utilizing state information of the computer readable program instructions to personalize the electronic circuitry, in order to perform aspects of the present disclosure.

The flowchart and block diagrams in the figures illustrate the architecture, functionality, and operation of possible implementations of apparatus (systems), methods and computer program products according to various implementations of the present disclosure. It will be understood that each block in the flowchart and/or block diagrams, and combinations of blocks in the flowchart and/or block diagrams, may represent a module, segment, or portion of code, which comprises one or more executable computer program instructions for implementing the specified logical function (s)/act(s). These computer program instructions may be provided to a processor of a general purpose computer, special purpose computer, or other programmable data processing apparatus to produce a machine, such that the computer program instructions, which may execute via the processor of the computer or other programmable data processing apparatus, create the ability to implement one or more of the functions/acts specified in the flowchart and/or block diagram block or blocks or combinations thereof. It should be noted that, in some alternative implementations, the functions noted in the block(s) may occur out of the order noted in the figures. For example, two blocks shown in succession may, in fact, be executed substantially concurrently, or the blocks may sometimes be executed in the reverse order, depending upon the functionality involved.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks or combinations thereof.

The computer program instructions may also be loaded onto a computer or other programmable data processing apparatus to cause a series of operational steps to be performed (not necessarily in a particular order) on the computer or other programmable apparatus to produce a computer implemented process such that the instructions which execute on the computer or other programmable apparatus provide steps for implementing the functions/acts (not necessarily in a particular order) specified in the flowchart and/or block diagram block or blocks or combinations thereof.

Referring now to FIG. 1, there is shown audio process 10 that may reside on and may be executed by a computer (e.g., audio system 12), which may be connected to a network (e.g., network 14) (e.g., the internet or a local area network). Examples of audio system 12 (and/or one or more of the client electronic devices noted below) may include, but are not limited to, an audio system, a personal computer(s), a laptop computer(s), mobile computing device(s), a server computer, a series of server computers, a mainframe computer(s), or a computing cloud(s). Audio system 12 may execute an operating system, for example, but not limited to, Microsoft® Windows® Mac® OS X®; Red Hat® Linux®, or a custom operating system. (Microsoft and Windows are registered trademarks of Microsoft Corporation in the United States, other countries or both; Mac and OS X are registered trademarks of Apple Inc. in the United States, other countries or both; Red Hat is a registered trademark of Red Hat Corporation in the United States, other countries or both; and Linux is a registered trademark of Linus Torvalds in the United States, other countries or both).

As will be discussed below in greater detail, audio process 10 may receive an indication that a first module is operatively connected to a main module, wherein the first module and the main module may include hardware modules. A type of speaker operatively connected to the first module may be identified. The type of speaker may be matched to a speaker profile, wherein the speaker profile may include a predefined sound curve setting. The first module may be tuned to the predefined sound curve setting based upon, at least in part, matching the type of speaker to the speaker profile.

The instruction sets and subroutines of audio process 10, which may be stored on storage device 16 coupled to audio system 12, may be executed by one or more processors (not shown) and one or more memory architectures (not shown) included within audio system 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

Audio system 12 may include a data store, such as a database (e.g., relational database, object-oriented database, triplestore database, etc.) and may be located within any suitable memory location, such as storage device 16 coupled to audio system 12. Any data described throughout the present disclosure may be stored in the data store. In some implementations, audio system 12 may utilize a database management system such as, but not limited to, "My Structured Query Language" (MySQL®) in order to provide multi-user access to one or more databases, such as the above noted relational database. The data store may also be a custom database, such as, for example, a flat file database or an XML database. Any other form(s) of a data storage structure and/or organization may also be used. Audio process 10 may be a component of the data store, a stand alone application that interfaces with the above noted data store and/or an applet/application that is accessed via client applications 22, 24, 26, 28. The above noted data store may be, in whole or in part, distributed in a cloud computing topology. In this way, audio system 12 and storage device 16 may refer to multiple devices, which may also be distributed throughout the network.

Audio system 12 may execute a music application (e.g., music application 20), examples of which may include, but are not limited to, e.g., a music management application, analog and/or digital signal processing application, or other application that allows for the use of an audio sound system. Audio process 10 and/or music application 20 may be accessed via client applications 22, 24, 26, 28. Audio process 10 may be a stand alone application, or may be an applet/application/script/extension that may interact with and/or be executed within music application 20, a component of music application 20, and/or one or more of client applications 22, 24, 26, 28. Music application 20 may be a stand alone application, or may be an applet/application/script/extension that may interact with and/or be executed within audio process 10, a component of audio process 10, and/or one or more of client applications 22, 24, 26, 28. One or more of client applications 22, 24, 26, 28 may be a stand alone application, or may be an applet/application/script/extension that may interact with and/or be executed within and/or be a component of audio process 10 and/or music application 20. Examples of client applications 22, 24, 26, 28 may include, but are not limited to, e.g., a music management application, signal processing application, or other application that allows for the use of an audio sound system, a standard and/or mobile web browser, an email client application, a textual and/or a graphical user interface, a customized web browser, a plugin, an Application Programming Interface (API), or a custom application. The instruction sets and subroutines of client applications 22, 24, 26, 28, which may be stored on storage devices 30, 32, 34, 36, coupled to client electronic devices 38, 40, 42, 44, may be executed by one or more processors (not shown) and one or more memory architectures (not shown) incorporated into client electronic devices 38, 40, 42, 44.

Storage devices 30, 32, 34, 36, may include but are not limited to: hard disk drives; flash drives, tape drives; optical drives; RAID arrays; random access memories (RAM); and read-only memories (ROM). Examples of client electronic devices 38, 40, 42, 44 (and/or audio system 12) may include, but are not limited to, a personal computer (e.g., client electronic device 38), a laptop computer (e.g., client electronic device 40), a smart/data-enabled, cellular phone (e.g., client electronic device 42), a notebook computer (e.g., client electronic device 44), a tablet (not shown), a server (not shown), a television (not shown), a smart television (not shown), a media (e.g., video, photo, etc.) capturing device (not shown), and a dedicated network device (not shown). Client electronic devices 38, 40, 42, 44 may each execute an operating system, examples of which may include but are not limited to, Android™, Apple® iOS®, Mac® OS X®; Red Hat® Linux®, or a custom operating system.

One or more of client applications 22, 24, 26, 28 may be configured to effectuate some or all of the functionality of audio process 10 (and vice versa). Accordingly, audio process 10 may be a purely server-side application, a purely client-side application, or a hybrid server-side/client-side application that is cooperatively executed by one or more of client applications 22, 24, 26, 28 and/or audio process 10.

One or more of client applications 22, 24, 26, 28 may be configured to effectuate some or all of the functionality of music application 20 (and vice versa). Accordingly, music application 20 may be a purely server-side application, a purely client-side application, or a hybrid server-side/client-side application that is cooperatively executed by one or more of client applications 22, 24, 26, 28 and/or music application 20. As one or more of client applications 22, 24, 26, 28, audio process 10, and music application 20, taken singly or in any combination, may effectuate some or all of the same functionality, any description of effectuating such functionality via one or more of client applications 22, 24, 26, 28, audio process 10, music application 20, or combination thereof, and any described interaction(s) between one or more of client applications 22, 24, 26, 28, audio process 10, music application 20, or combination thereof to effectuate such functionality, should be taken as an example only and not to limit the scope of the disclosure.

Users 46, 48, 50, 52 may access audio system 12 and audio process 10 (e.g., using one or more of client electronic devices 38, 40, 42, 44) directly through network 14 or through secondary network 18. Further, audio system 12 may be connected to network 14 through secondary network 18, as illustrated with phantom link line 54. Audio process 10 may include one or more user interfaces, such as browsers and textual or graphical or physical user interfaces, through which users 46, 48, 50, 52 may access audio process 10.

The various client electronic devices may be directly or indirectly coupled to network 14 (or network 18). For example, client electronic device 38 is shown directly coupled to network 14 via a hardwired network connection. Further, client electronic device 44 is shown directly coupled to network 18 via a hardwired network connection. Client electronic device 40 is shown wirelessly coupled to network 14 via wireless communication channel 56 established between client electronic device 40 and wireless access point (i.e., WAP) 58, which is shown directly coupled to network 14. WAP 58 may be, for example, an IEEE 802.11a, 802.11b, 802.11g, Wi-Fi®, and/or Bluetooth™ device that is capable of establishing wireless communication channel 56 between client electronic device 40 and WAP 58. Client electronic device 42 is shown wirelessly coupled to network 14 via wireless communication channel 60 established between client electronic device 42 and cellular network/bridge 62, which is shown directly coupled to network 14.

Some or all of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth™ is a telecommunications industry specification that allows, e.g., mobile phones, computers, smart phones, and other electronic devices to be interconnected using a short-range wireless connection. Other forms of interconnection (e.g., Near Field Communication (NFC)) may also be used.

Figure 2:
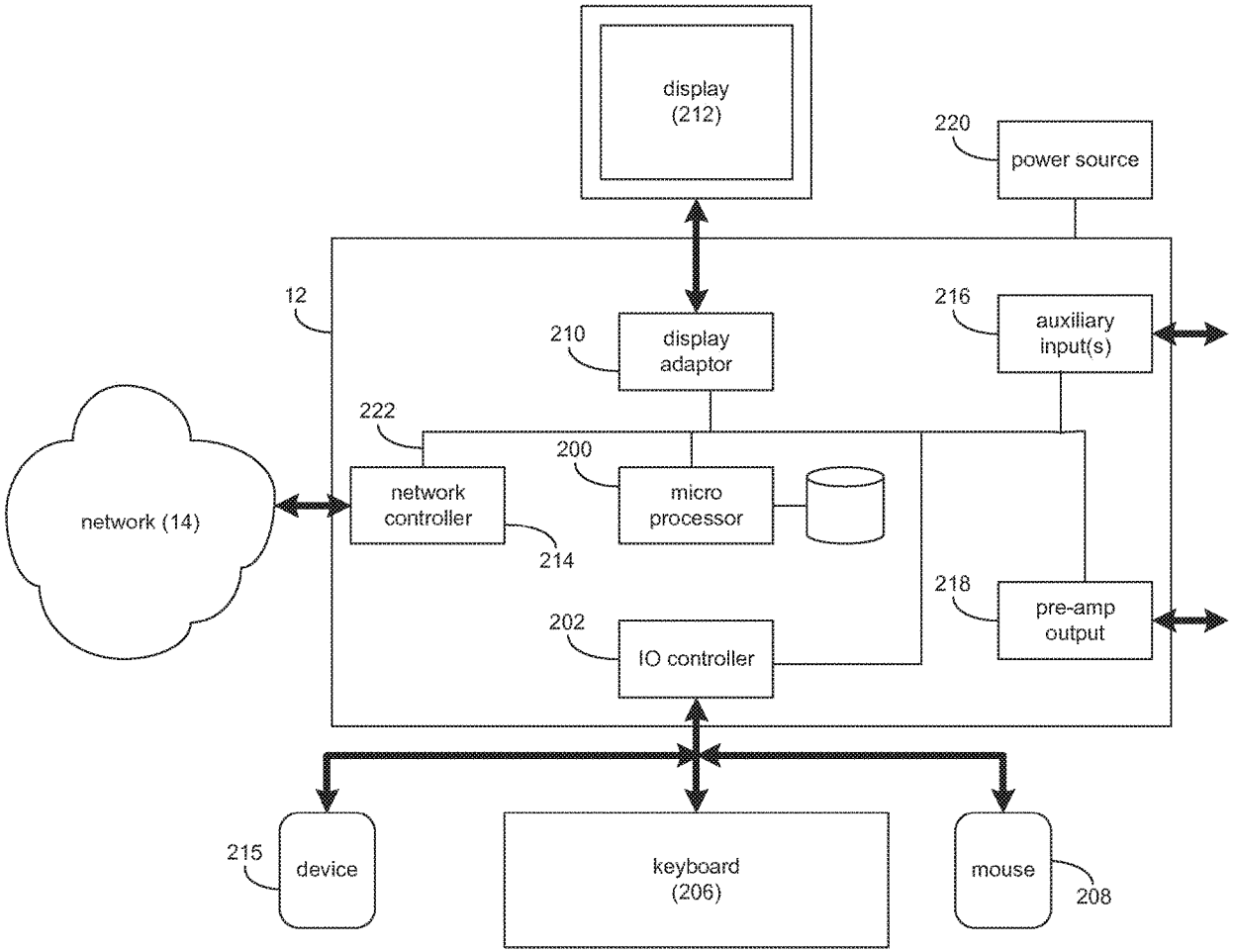
FIG. 2 is an example diagrammatic view of an audio system of FIG. 1 according to one or more example implementations of the disclosure.
Figure 3:
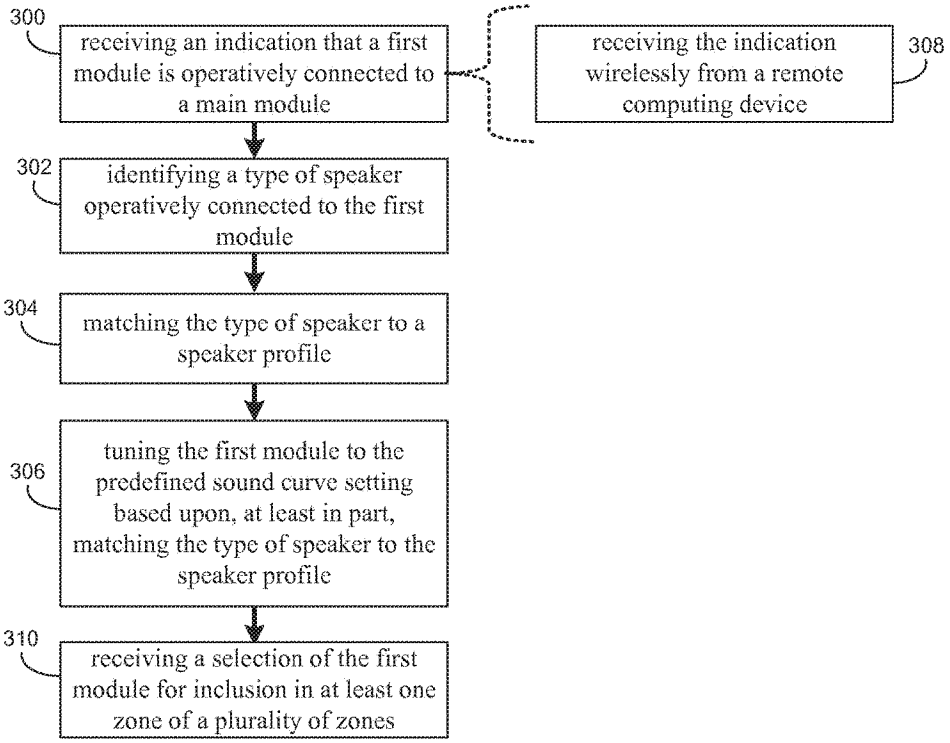
FIG. 3 is an example flowchart of the audio process of FIG. 1 according to one or more example implementations of the disclosure.
Figure 4:
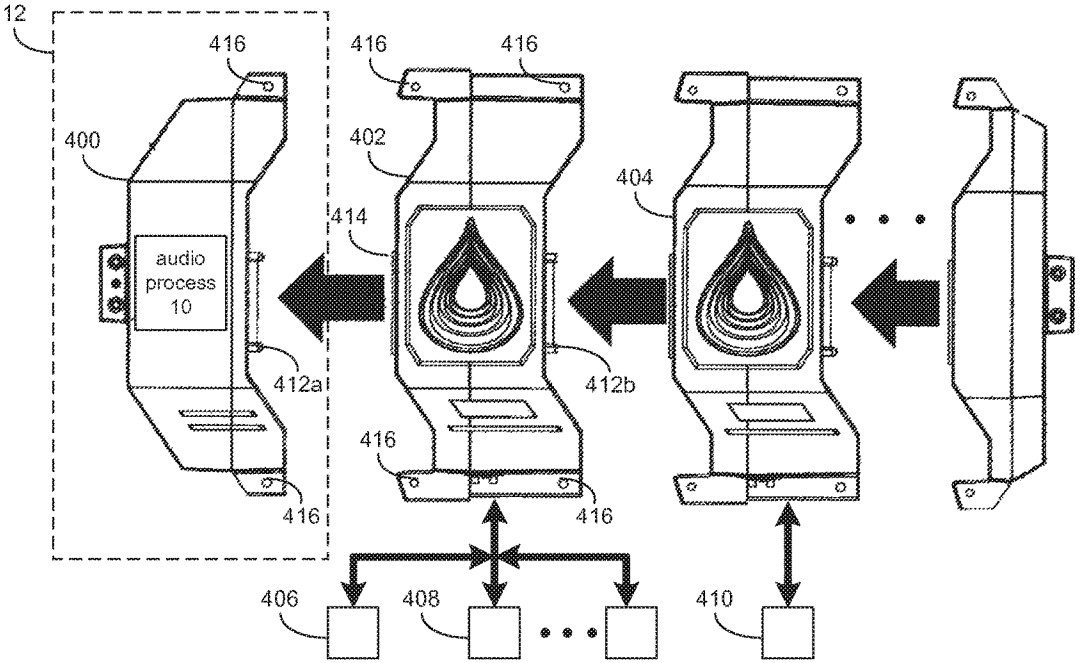
FIG. 4 is an example diagrammatic view of an audio system of FIG. 1 according to one or more example implementations of the disclosure.
Figure 5:
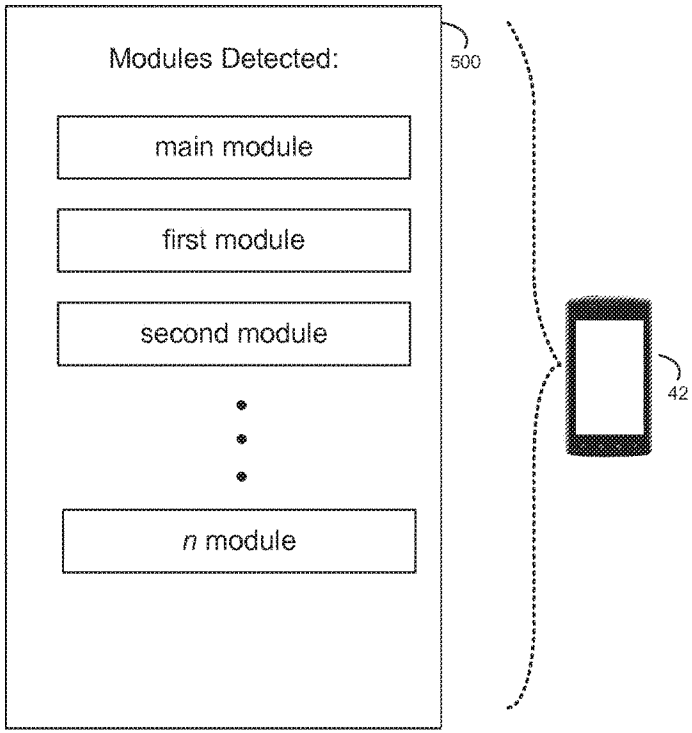
FIG. 5 is an example diagrammatic view of a screen image displayed by the audio process of FIG. 1 according to one or more example implementations of the disclosure.
Figure 6:
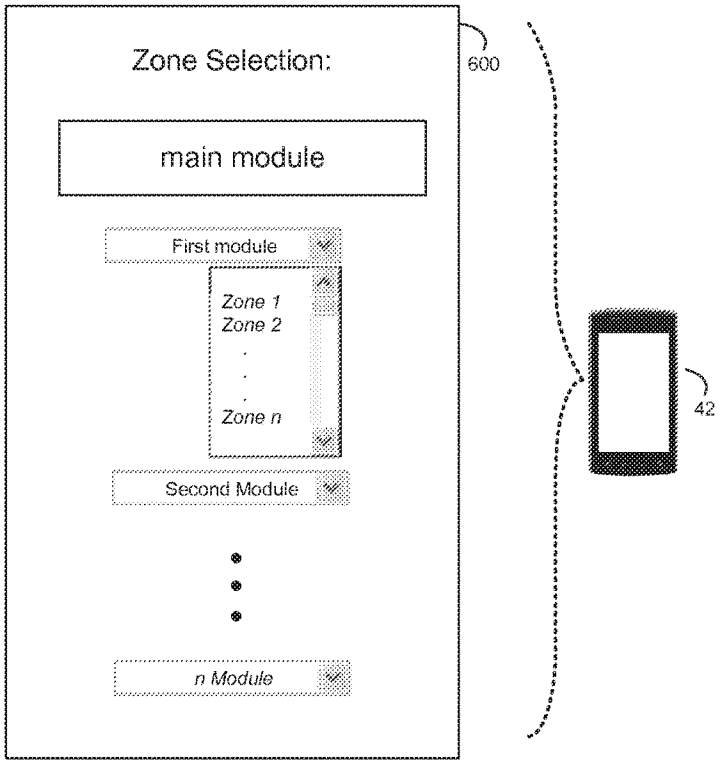
FIG. 6 is an example diagrammatic view of a screen image displayed by the audio process of FIG. 1 according to one or more example implementations of the disclosure.

Referring also to FIG. 2, there is shown a diagrammatic view of audio system 12. While audio system 12 is shown in this figure, this is for illustrative purposes only and is not intended to be a limitation of this disclosure, as other configurations are possible. For example, any computing device capable of executing, in whole or in part, audio process 10 may be substituted for audio system 12 within FIG. 2, examples of which may include but are not limited to client electronic devices 38, 40, 42, 44.

Audio system 12 may include a processor and/or microprocessor (e.g., microprocessor 200) configured to, e.g., process data and execute the above-noted code/instruction sets and subroutines. Microprocessor 200 may be coupled via a storage adaptor (not shown) to the above-noted storage device(s) (e.g., storage device 16). An I/O controller (e.g., I/O controller 202) may be configured to couple microprocessor 200 with various devices, such as keyboard 206, pointing/selecting device (e.g., mouse 208), custom device (e.g., device 215), etc. A display adaptor (e.g., display adaptor 210) may be configured to couple display 212 (e.g., CRT or LCD monitor(s), stereo panel display, etc.) with microprocessor 200, while network controller/adaptor 214 (e.g., an Ethernet adaptor) may be configured to couple microprocessor 200 to the above-noted network 14 (e.g., the Internet or a local area network). Audio system 12 may include, e.g., auxiliary inputs (e.g., auxiliary inputs 216), such as 3.5 mm/USB/RCA, etc., pre-amp output(s) (e.g., pre-amp output 218), an internal and/or external power source (e.g., power source 220), a data bus (e.g., I2C data bus 222), etc. Audio process 10 may provide, e.g., a high-power interface to allow the primary power source (e.g., power source 220) to be fed on to the connected modules (discussed below).

The Audio Process:

As discussed above and referring also at least to FIGS. 3-6, audio process 10 may receive 300 an indication that a first module is operatively connected to a main module, wherein the first module and the main module may include hardware modules. A type of speaker operatively connected to the first module may be identified 302 by audio process 10. The type of speaker may be matched 304 to a speaker profile by audio process 10, wherein the speaker profile may include a predefined sound curve setting. Audio process 10 may tune 306 the first module to the predefined sound curve setting based upon, at least in part, matching 304 the type of speaker to the speaker profile.

As noted above, in some implementations, audio process 10 may receive 300 an indication that a first module is operatively connected to a main module, wherein the first module and the main module may include hardware modules. For instance, and referring at least to FIG. 4, assume for example purposes only that audio system 12 includes a main module (e.g., main module 400). In the example, main module 400 may include a connector (e.g., multipin connector 412*a*) that operatively connects main module 400 to the first module. The first module (e.g., module 402) may have a multipin connector (e.g., multipin connector 414*a*) that is compatible with the multipin connector of main module 400, to allow a physical connection between them. Similarly, in some implementations, first module 402 may include a multipin connector (e.g., multipin connector 412*b*), which may allow other modules to connect to first module 402 (and therefore main module 400) as shown in example FIG. 4. In some implementations, digital audio sources may be sent to the individual modules via, e.g., an inter-module digital output data connector (e.g., multipin connector 412*a* and 412*b*) in, e.g., I2S format. However, it will be appreciated that any specialized connectors and/or formats may be used without departing from the scope of the disclosure. Additionally, it will be appreciated that other types of connectors (both physical and wireless) may be used without departing from the scope of the disclosure. As such, the use of multipin connector should be taken as an example only and not to limit the scope of the disclosure. Main module 400, as well as module 402, may include holes 416 to be secured to a surface using, e.g., screws or other fasteners. Other techniques of securing main module 400 and module 402 may be used without departing from the scope of the disclosure.

In some implementations, first module 402 may accept input power from the main power source (e.g., power source 220), which may be, e.g., a boat battery, car battery, etc. The input power may be passed through to other connected modules (e.g., main module 400, second module 404, etc.).

In some implementations, receiving 300 the indication that first module 402 is operatively connected to main module 400 may include audio process 10 receiving 300 the indication using traditional "plug and play" techniques resulting from the physical connection between first module 402 and main module 400 (e.g., a specification that may facilitate the discovery of a hardware component in audio system 12 without the need for physical device configuration or user intervention in resolving resource conflicts).

In some implementations, receiving 300 the indication that first module 402 is operatively connected to main module 400 may include audio process 10 receiving 308 the indication wirelessly from a remote computing device. For instance, assume for example purposes only that client computing device 42 (via client application 26, music application 20, audio process 10 or combination thereof) generates a user interface (e.g., user interface 500 of FIG. 5) that shows one or more modules (e.g., first module 402 and second module 404), that may be physically connected to main module 400. Main module 400 may also be visible in user interface 500. In the example, audio process 10 may (via the user interface) enable user 50 to select first module 402 (or other module(s) singularly or in any combination which is shown on the user interface). In the example, once audio process 10 receives 308 the selection, communication between first module 402 and main module 400 may be established, as will be discussed in greater detail below. It will be appreciated that the indication may be received 300 via a direct physical connection without departing from the scope of the disclosure. For example, the indication may be received 300 via a wired remote control and/or via display 212. As such, the use of receiving 300 a wireless indication should be taken as an example only and not to limit the scope of the disclosure.

In some implementations, first module 402 may include, e.g., a digital amplifier, which may be external and/or internal to audio system 12. However, first module 402 (as well as any other modules capable of connecting to main module 400) may include other devices, such as a subwoofer, additional main modules, fan, or other device capable of being used with the disclosure. For example, module 402 may include a fan that may, e.g., enable it to be controlled by main module 400 based on system needs. As another example, module 402 may include an "end unit module", which may include a secondary power source that may be used when a certain number of modules (e.g., 4) are using the same power source, and where there would be insufficient power if a fifth module were added. Additionally, first module 402 may include a heat sink and/or an airflow channel to allow forced-air cooling of certain components and/or multiple modules. As another example, any module (e.g., first module 402) may include some or all the components of any of the other modules (e.g., main module 400, secondary module 404, etc.) without departing from the scope of the disclosure. As such, the description of an amplifier as first module 402 and/or a particular configuration of main module 400 or first module 402 should be taken as an example only and not to limit the scope of the disclosure.

In some implementations, a type of speaker operatively connected to the first module may be identified 302 by audio process 10. For instance, and continuing with the above example, assume for example purposes only that first module 402 is selected via user interface 500. In the example, audio process 10 may identify information associated with first module 402 (e.g., model, size, brand, status, temperature, etc.). In some implementations, the information associated with first module 402 may include a unique ID.

In some implementations, user interface 500 may display a list of related products (e.g., speakers) that may be physically and/or wireless used with first module 402. The list may be based upon, e.g., the above-noted information associated with first module 402 (e.g., model, size, brand, unique ID, etc.). User interface 500 may enable user 50 to select the appropriate speaker to be used. In some implementations, the type of speaker operatively connected to first module 402 may be automatically identified 302 when first module 402 is operatively connected to main module 400. For instance, audio process 10 may use the identity information associated with first module 402 to determine that a particular type of speaker is already operatively connected to main module 400 and/or that only one type of speaker is compatible with first module 402. This may obviate having user 50 manually select the appropriate speaker.

In some implementations, the type of speaker may be matched 304 to a speaker profile by audio process 10, wherein the speaker profile may include a predefined sound curve setting. For example, each speaker may be unique in that the sound signal received by the amplifier (e.g., first module 402) may be improved if the amplifier settings specific to the identified 302 speaker are tuned as closely as possible to a "perfect sound curve". The settings used in the predefined sound curve setting may include, e.g., tone controls such as fade, gain, volume, signal filtering, signal enhancement, treble, midrange, bass, or other equalizer settings (e.g., outboard, parametric, etc.), subwoofer control, etc. As such, in the example, if speaker X (shown as speaker 406 in FIG. 4) is identified 302 by audio process 10 for use with first module 402, audio process 10 may match speaker X with the "Speaker X" profile, which may contain, e.g., the amplifier settings specific to speaker X that when tuned, may result in a sound as close as possible to a "perfect sound curve" (e.g., best possible sound with the given equipment). Similarly, in the example, if speaker Y (shown as speaker 408 in FIG. 4) is identified 302 by audio process 10 for use with first module 402, audio process 10 may match speaker Y with the "Speaker Y" profile, which may contain, e.g., the amplifier settings specific to speaker Y that when tuned, may result in a sound as close as possible to a "perfect sound curve".

It will be appreciated that various other amplifier settings besides those settings to achieve the perfect sound curve may also be used without departing from the scope of the disclosure. For example, user 50 may prefer different settings, which may then be associated with the desired speaker profile in place of and/or in addition to the perfect sound curve settings. As such, the description of the predefined sound curve setting being the "perfect sound curve" should be taken as an example only and not to limit the scope of the disclosure.

In some implementations, the speaker profile may be stored within main module 400. For example, main module 400 may include, e.g., data storage device 16, which may be used to locally store one or more speaker profiles for various speakers. In the example, if speaker Y is identified 302 by audio process 10 for use with first module 402, audio process 10 may match speaker Y with the "Speaker Y" profile stored in data storage device 16, which may contain, e.g., the amplifier settings specific to speaker Y that when tuned, may result in a sound as close as possible to a "perfect sound curve". In some implementations, the speaker profiles may be stored remotely and retrieved by audio process 10 when needed. In some implementations, the speaker profiles in data storage device 16 may be updated from the remote storage with, e.g., new speaker profiles and/or new amplifier settings for a particular speaker.

In some implementations, audio process 10 may tune 306 first module 402 to the predefined sound curve setting based upon, at least in part, matching 304 the type of speaker to the speaker profile. For instance, and continuing with the above example, if speaker X is identified 302 by audio process 10 for use with first module 402, audio process 10 may tune first module 402 according to the predefined sound curve settings in the "Speaker X" profile. Similarly, if speaker Y is identified 302 by audio process 10 for use with first module 402, audio process 10 may tune first module 402 according to the predefined sound curve settings in the "Speaker Y" profile. In some implementations, audio process 10 may tune 306 first module 402 to accommodate multiple speaker profiles when different speaker types (e.g., speaker X and speaker Y) are simultaneously used.

In some implementations, user interface 500 may enable user 50 to manually select which speaker profile to use when audio process 10 is to tune first module 302. For instance, in the example, user interface 500 may, as discussed above, display each speaker type as appropriate for first module 402, where user 50 may select one or more of, e.g., "Speaker X" profile, "Speaker Y" profile, "Override" profile (e.g., with the personalized tuning settings preferred by user 50 or the tuning setting specific to a genre of music such as rock, pop, jazz, etc.), etc.

In some implementations, first module 402 may be automatically tuned 306 by main module 400 to the predefined sound curve setting based upon, at least in part, matching 304 the type of speaker to the speaker profile. For example, audio process 10 may automatically (e.g., without receiving a manual selection from user 50) tune 306 first module 402 according to the above-noted predefined sound curve settings matched 304 to the identified 302 speaker. In some implementations, as one or more of the above-noted actions of audio process 10 may be automated, audio process 10 may enable user 50 to easily set up and configure (i.e., tune) the amplifier with the minimum act of connecting first module 402.

In some implementations, a selection of first module 402 for inclusion in at least one zone of a plurality of zones may be received 310 by audio process 10, wherein each module included in the at least one zone may operate in sync. For instance, and referring at least to FIG. 6, assume for example purposes only that client computing device 42 (via client application 26, music application 20, audio process 10 or combination thereof) generates a user interface (e.g., user interface 600). User interface 600 may enable user 50 to select which modules may be used for one or more specific zones. For example, and continuing with the above example, user 50 may want first module 402 (and its connected speakers 406 and/or 408) to be included in a particular zone (e.g., "Zone 1"). "Zone 1" may include, e.g., one or more locations in a house, car, boat, etc. As such, in the example, if audio process 10 receives 310 a selection from user 50 that first module 402 is to be included in "Zone 1", and if "Zone 1" is the upper location of a boat, then each speaker 406 and/or 408 connected to first module 402 may play the same audio (e.g., the same song) in the upper location of a boat. Similarly, in the example, if audio process 10 receives 310 a selection from user 50 that first module 402 is to be included in "Zone 2", and if "Zone 2" is the lower location of a boat, then each speaker 406 and/or 408 connected to first module 402 may play the same audio in the lower location of the boat.

In some implementations, each module included in the at least one zone may be individually controllable while operating in sync. For example, and continuing with the above example where audio process 10 receives 310 a selection from user 50 that first module 402 is to be included in "Zone 1", audio process 10 may (via user interface 600) also receive a selection from user 50 to enable individual control of speakers 406 and 408 even while playing the same audio. For example, even though speaker 406 and 408 may be playing the same audio in "Zone 1", audio process 10 may enable individual control over, e.g., volume, fade, equalization settings, etc. to speaker 406 to be set to a particular level respectively, while simultaneously enabling individual control over, e.g., volume, fade, equalization settings, etc. to speaker 408 to be set to different particular levels respectively than speaker 406. In some implementations, and similarly as noted above, audio process 10 may enable individual control of each module included in the particular zone. For instance, assume for example purposes only that module 402 and module 404 are included in "Zone 1". In the example, even when playing the same audio, audio process 10 may enable individual control of module 402 settings (as discussed throughout) while simultaneously enabling individual control of module 404 settings that may differ from that of module 402.

In some implementations, audio process 10 may enable user 50 (e.g., via user interface 600) to select multiple zones simultaneously. For instance, and continuing with the above example, assume for example purposes only that user 50 desires to have different audio (e.g., a rock song and a classical song) playing in "Zone 1" and "Zone 2" respectively at the same time. In the example, if audio process 10 receives 310 a selection from user 50 that first module 402 is to be included in "Zone 1", and if audio process 10 also receives 310 a selection from user 50 that second module 404 is to be included in "Zone 2", then each speaker 406 and/or 408 connected to first module 402 may the play rock song in "Zone 1" in the upper location of a boat, while each speaker connected to second module 404 (shown as speaker 410 in FIG. 4) may play the classical song in "Zone 2" in the lower location of a boat. In some implementations, user interface 600 may include an option (not shown) to enable user 50 to select the audio source for each zone. For example, user interface 600 may include a drop down menu showing connected sources and/or their audio selection (e.g., playlists, radio, etc.). In the example, user interface 600 may enable user 50 to associate a playlist from, e.g., client computing device 50 with "Zone 1" and/or first module 402, and to associate a radio station with "Zone 2" and/or second module 404.

In some implementations, user interface 600 may be more granular. For instance, the various speakers may be included in the various zones individually. For example, user interface 600 may enable user 50 to select which speakers may be used for one or more specific zones. For example, and continuing with the above example, user 50 may want speaker 406 to be included in "Zone 1" and speaker 408 to be included in "Zone 2". In the example, if audio process 10 receives 310 a selection from user 50 that speaker 406 is to be included in "Zone 1", and/or if audio process 10 receives 310 a selection from user 50 that speaker 408 is to be included in "Zone 2", then speaker 406 connected to first module 402 may the play rock song in "Zone 1" in the upper location of a boat, while speaker 408 also connected to first module 402 may play the classical song in "Zone 2" in the lower location of a boat.

In some implementations, at least one module may be identified by external display. For example, one or more of the modules (e.g., main module 400, module 402, module 404, etc.) may include one or more light emitting diodes (LEDs) that may be visible to user 50. In the example, audio process 10 may control the visible LED's, e.g., on one or more of the modules (e.g., module 402), to indicate the identification of the module as module 402. In some implementations, the identification may include the module's status (e.g., zone, playlist, song currently playing, etc.). User interface 600 may also be enabled to display the module's status.

The terminology used herein is for the purpose of describing particular implementations only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents of all means or step plus function elements that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, and any combinations thereof will be apparent to those of ordinary skill in the art without departing from the scope and spirit of the disclosure. The implementation(s) were chosen and described in order to best explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, and combinations thereof) are possible without departing from the scope of the disclosure defined in the appended claims.

The invention claimed is:

1. A modular audio system for a vehicle, comprising:

a main module and a first module, the main module including an audio process, stored on a storage device, for receiving an indication that the first module is operatively connected to the main module; and an end unit module adapted to operatively connect to the first module, or one or more secondary modules operatively connected to the first module;

wherein, the main module, the first module, any one or more secondary modules, and the end module are hardware modules operatively connected via physical connectors, and are adapted to be powered from a main power source and, if available, a secondary power source of the vehicle.

2. The modular audio system of claim 1, wherein the main module is connected to a main power source, and the end unit module is connected to the secondary power source.

3. The modular audio system of claim 1, wherein at least one of the first module and the one or more secondary modules includes a digital amplifier powered by the main power source, or, if available, the secondary power source, the digital amplifier adapted to amplify an audio signal received from the audio process.

4. The modular audio system of claim 1, wherein at least one of the first module and the one or more secondary modules includes a system hardware component controllable by the main module.

5. The modular audio system of claim 4, wherein the system hardware component is a speaker addressable by the audio process of the main module.

6. The modular audio system of claim 5, wherein the speaker addressable by the audio processor is a subwoofer.

7. The modular audio system of claim 5, further comprising a plurality of speakers addressable by the audio processor.

8. The modular audio system of claim 7, wherein the main module includes speaker profiles with a predefined sound curve for matching to the plurality of speakers.

9. The modular audio system of claim 7, wherein the plurality of speakers are addressable by the audio processor to output a synchronized audio signal intended for a listening zone of the vehicle.

10. The modular audio system of claim 7, wherein plurality of speakers are addressable by the audio processor to output a plurality of audio signals to different listening zones of the vehicle.

11. The modular audio system of claim 4, wherein the system hardware component is a fan operable by the main module to provide an air flow for air cooling components.

12. The modular audio system of claim 1, wherein the audio process of the main module is further adapted to receive an indication that the first module is operatively connected via a "plug-and-play" technique resulting from the physical connection between the main module and the first module.

13. The modular audio system of claim 1, wherein the audio process of the main module is further adapted to receive an indication that the one or more secondary modules are operatively connected via the "plug-and-play" technique.

14. The modular audio system of claim 1, wherein the main module, the first module, any one or more secondary modules, and the end unit module are connected via an inter-module digital output data connector.

15. The modular audio system of claim 14, wherein the inter-module digital output data connector is a multipin bus connector in I2S format.

16. The modular audio system of claim 1, wherein the main module determines any expansion of the first module and any one or more secondary modules to determine an updated configuration of the modular audio system.

17. The modular audio system of claim 1, wherein at least one or more of the main module, the first module, any one or more secondary modules, and the end module are operatively connected wirelessly.

18. The modular audio system of claim 17, wherein the audio process of the main module is adapted to wirelessly address one or more system hardware components in one or more hardware modules.

19. The modular audio system of claim 18, wherein the audio process of the main module is adapted to wirelessly address an audio signal to a listening zone of the vehicle.

20. The modular audio system of claim 18, wherein the audio process of the main module is adapted to wirelessly address a plurality of audio signals to different listening zones of the vehicle.

* * * * *